US006338439B1

(12) United States Patent
Goenka et al.

(10) Patent No.: US 6,338,439 B1
(45) Date of Patent: Jan. 15, 2002

(54) NOZZLE ASSEMBLY

(75) Inventors: Lakhi Nandlal Goenka, Ann Arbor; Marc Alan Straub, Dearborn Heights; Jay D Baker, Dearborn, all of MI (US)

(73) Assignee: Visteon Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/470,138

(22) Filed: Dec. 22, 1999

(51) Int. Cl.[7] ..... B05B 17/00; F23D 11/10

(52) U.S. Cl. ..... 239/8; 239/418; 239/419; 239/422; 239/423; 239/424.5; 239/428; 239/429; 239/430

(58) Field of Search ..... 239/418, 419, 239/422, 423, 424.5, 428, 429, 430, 8

(56) References Cited

U.S. PATENT DOCUMENTS

| | | | | |
|---|---|---|---|---|
| 4,805,341 A | | 2/1989 | Maeda et al. | |
| 4,807,814 A | | 2/1989 | Douche et al. | |
| 5,284,554 A | | 2/1994 | Datta et al. | |
| 5,445,185 A | | 8/1995 | Watanabe et al. | |
| 5,545,073 A | | 8/1996 | Kneisel et al. | |
| 5,566,703 A | | 10/1996 | Watanabe et al. | |
| 5,586,725 A | * | 12/1996 | Ballu | 239/419.5 |
| 5,679,062 A | | 10/1997 | Goenka et al. | |
| 5,779,523 A | | 7/1998 | Mesher et al. | |
| 5,815,181 A | | 9/1998 | Kashino et al. | |
| 5,836,150 A | | 11/1998 | Garcia | |
| 5,901,908 A | | 5/1999 | Goenka et al. | |
| 5,920,013 A | | 7/1999 | Boardman et al. | |

* cited by examiner

*Primary Examiner*—Robin O. Evans
(74) *Attorney, Agent, or Firm*—Visteon Global Tech., Inc.

(57) ABSTRACT

A nozzle assembly 10 including a first inlet aperture 12 which receives material 14 which is to be selectively emitted from assembly 10. Assembly 10 includes an outlet aperture 16 having several apertures 18, 20, 22, 24, and 26 which are respectively separated by substantially identical elements 28, 30, 32, and 34. Elements 28–34 cooperatively form a plurality of passages or channels 40–50 through assembly 10. A centrally disposed channel 44 is relatively narrower than the other channels 40, 42, 46, and 50, and channels 42, 46 are relatively narrower than outermost channels 46, 50, thereby causing material 14 to be emitted at a substantially similar and/or uniform velocity at each point or location within outlet aperture 16.

19 Claims, 4 Drawing Sheets

NOZZLE ASSEMBLY

FIELD OF THE INVENTION

This invention relates to a nozzle assembly and more particularly, to a nozzle assembly which selectively emits material through an aperture at a relatively uniform velocity.

BACKGROUND OF THE INVENTION

Nozzles selectively emit various types of materials, such as and without limitation paint, thereby placing or depositing the selectively emitted material upon various objects and/or target locations in some desired pattern and/or concentration. Oftentimes it is highly desirable to place or deposit the emitted material on the targeted object and/or location in a substantially uniform concentration, thereby substantially preventing uneven material deposits which are unsightly and unaesthetic.

Moreover, it is also desirable to provide for the selective emission, by the nozzle, of a mixture of liquid and solid particles and/or a mixture of gas and solid particles in order to allow the nozzle to be used within a wide variety of applications requiring different types of materials.

While prior nozzle assemblies adequately and selectively emit material, they do not substantially ensure that the emitted material is uniformly placed upon the targeted object or location. Rather these prior nozzle assemblies typically emit a greater amount of the material through a center portion of the nozzle and lesser amounts around the nozzle end portions, thereby undesirably creating areas of relatively high material concentration upon the targeted object or location.

That is, the portion of the material which traverses the middle or center of the nozzle assembly has a greater velocity than those material portions which traverse the outer portions of nozzle assembly, thereby causing the material to have a non-uniform velocity profile as the material exits the outlet apertures of these nozzle assemblies (e.g. the velocity of the emitted material is not uniform at substantially every point or location within the outlet aperture). Hence, more material is deposited through the center portion of the respective outlet apertures of these prior nozzle assemblies than is deposited through the outer edge portions of the respective outlet apertures of these prior nozzle assemblies.

Moreover, while these prior nozzle assemblies allow for the selective emission of such liquid-solid and gaseous-solid mixtures, they must often and/or frequently be "unclogged" or cleaned since the solid particles tend to form undesirable and flow-restricting deposits within these prior nozzle assemblies. These "cleanings" reduce the overall efficiency and increase the cost of the material application process and further increase the non-uniformity of the velocity profile of the emitted material. Further, as new types of solid particles and/or materials are used by these prior nozzle assemblies, the respectively contained particle deposits become undesirably mixed with the new material, thereby undesirably contaminating the new material.

There is therefore a need for a new and improved nozzle assembly which allows for the selective emission of material having a substantially uniform velocity, which allows the selectively emitted material to be substantially and uniformly deposited upon a target object and/or location, which allows for the selective emission of material having a liquid and a solid component and/or material having a gaseous and a solid component, and which substantially prevents and/or reduces undesirable material deposits within the nozzle assembly.

SUMMARY OF THE INVENTION

It is a first object of the invention to provide a nozzle assembly which overcomes some or all of the previously delineated drawbacks of prior nozzle assemblies.

It is a second object of the invention to provide a nozzle assembly which overcomes some or all of the previously delineated drawbacks of prior nozzle assemblies and which allows material to be selectively emitted with a substantially uniform velocity profile.

It is a third object of the invention to provide a nozzle assembly which overcomes some or all of the previously delineated drawbacks of prior nozzle assemblies and which allows material to be selectively emitted and to be substantially and uniformly deposited upon a target object and/or location.

It is a fourth object of the invention to provide a nozzle assembly which overcomes some or all of the previously delineated drawbacks of prior nozzle assemblies and which allows mixtures of diverse types of material to be selectively emitted.

According to a first aspect of the present invention a nozzle assembly is provided. The nozzle assembly includes an outlet aperture having a first portion of a first cross sectional area and a second portion having a second cross sectional area, the second cross sectional area being smaller than the first cross sectional area.

According to a second aspect of the present invention a nozzle assembly is provided. The nozzle assembly is of the type which receives material and which emits the received material through an outlet aperture. The nozzle assembly includes a first narrow portion which receives the material and a second wider portion which communicates with the first portion and with the outlet aperture and which communicates the material to the outlet aperture.

According to a third aspect of the present invention a method is provided for use with a nozzle of the type having an outlet aperture. The nozzle is of the type which receives material and which selectively emits the received material through the outlet aperture. The method is effective to cause the material to be emitted at a substantially uniform pressure and includes the steps of causing a first portion of the outlet aperture to have a first cross sectional area and causing a second portion of the outlet aperture to have a second cross sectional area.

These and other features, aspects, and advantages of the invention will become apparent by reference to the following specification and by reference to the following drawings.

DETAILED DESCRIPTION OF THE PREFERRED EMBODIMENT OF THE INVENTION

Figure 1:
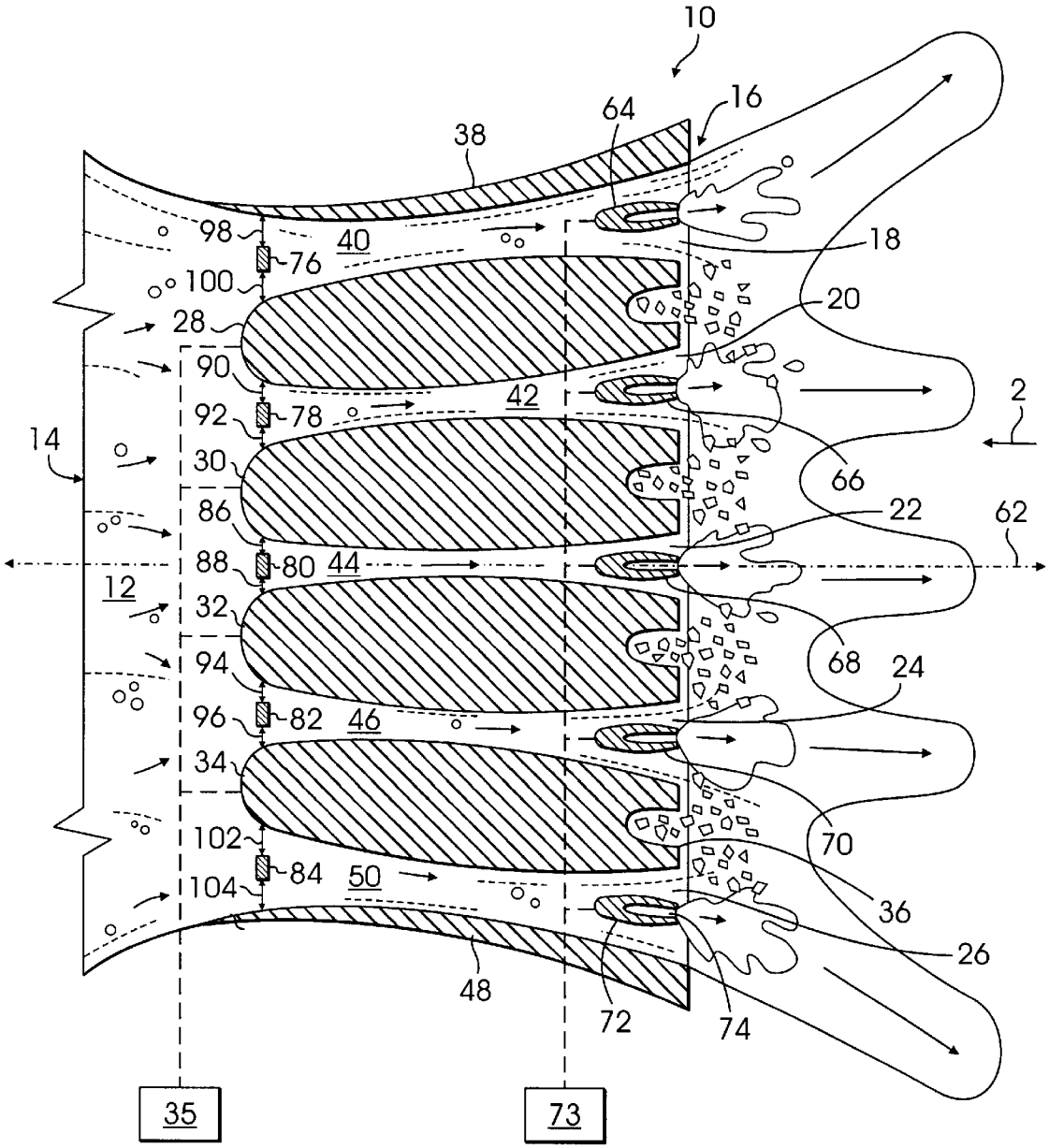
FIG. 1 is a side-sectional view of a nozzle assembly which is made in accordance with the teachings of the preferred embodiment of the invention.

Referring now to FIGS. 1, 2, 5, and 6, there is shown a nozzle assembly 10 which is made in accordance with the teachings of the preferred embodiment of the invention. Particularly, nozzle assembly 10 includes a first inlet aperture portion 12 which receives a first material 14 which is to be selectively emitted from assembly 10. In the preferred embodiment of the invention, material 14 comprises gaseous material. Nozzle assembly 10 further includes a second or outlet aperture portion 16 which is cooperatively comprised of and/or which includes several apertures 18, 20, 22, 24, and 26 which are respectively separated by substantially identical, generally ellipsoidal, and integrally formed elements 28, 30, 32, and 34. Each element 28–34 has a generally "C"-shaped notch or groove 36 which is positioned within the outlet aperture 16. As shown, element 28 cooperates with the top portion 38 of nozzle assembly 10 to form a passage or channel 40 which extends from the inlet aperture 12 to the aperture 18; elements 28 and 30 cooperatively form a channel or passage 42 which extends from the inlet aperture 12 to the aperture 20; elements 30 and 32 cooperatively form a passage or channel 44 which extends from the inlet aperture 12 to the aperture 22; elements 32 and 34 cooperatively form a passage or channel 46 which extends from the inlet aperture 12 to the aperture 24; and element 34 cooperates with the bottom portion 48 of the nozzle assembly 10 to form a passage or channel 50 which extends from the inlet aperture 12 to the aperture 26.

It should be realized that a different number and/or shape of apertures 18–26 may be used in other embodiments and that a different number and/or shape of elements 28–34 may be used in other embodiments of the invention. It should be further realized that elements 28–34 may each be selectively coupled to a source or receptacle 35 of solid or liquid particulate. In such an embodiment, the liquid and/or solid particulate material is selectively emitted from notches 36, such as by use of a tube (not shown) which is receivably contained within notches 36 and which is physically and communicatively coupled to source 35. In other alternate embodiments, other elements may be used to form channels 40–50, and elements 28–34 may be disposed in different locations upon and/or within nozzle assembly 10.

It should further be appreciated that channel 44 is relatively narrower than channels 40, 42, 46, and 50, and that channels 42 and 46 have substantially the same width and are narrower than channels 40 and 50. In one non-limiting embodiment, channels 42 and 46 are substantially similar in size and shape and channels 40 and 50 are substantially similar in size and shape.

Figure 2:
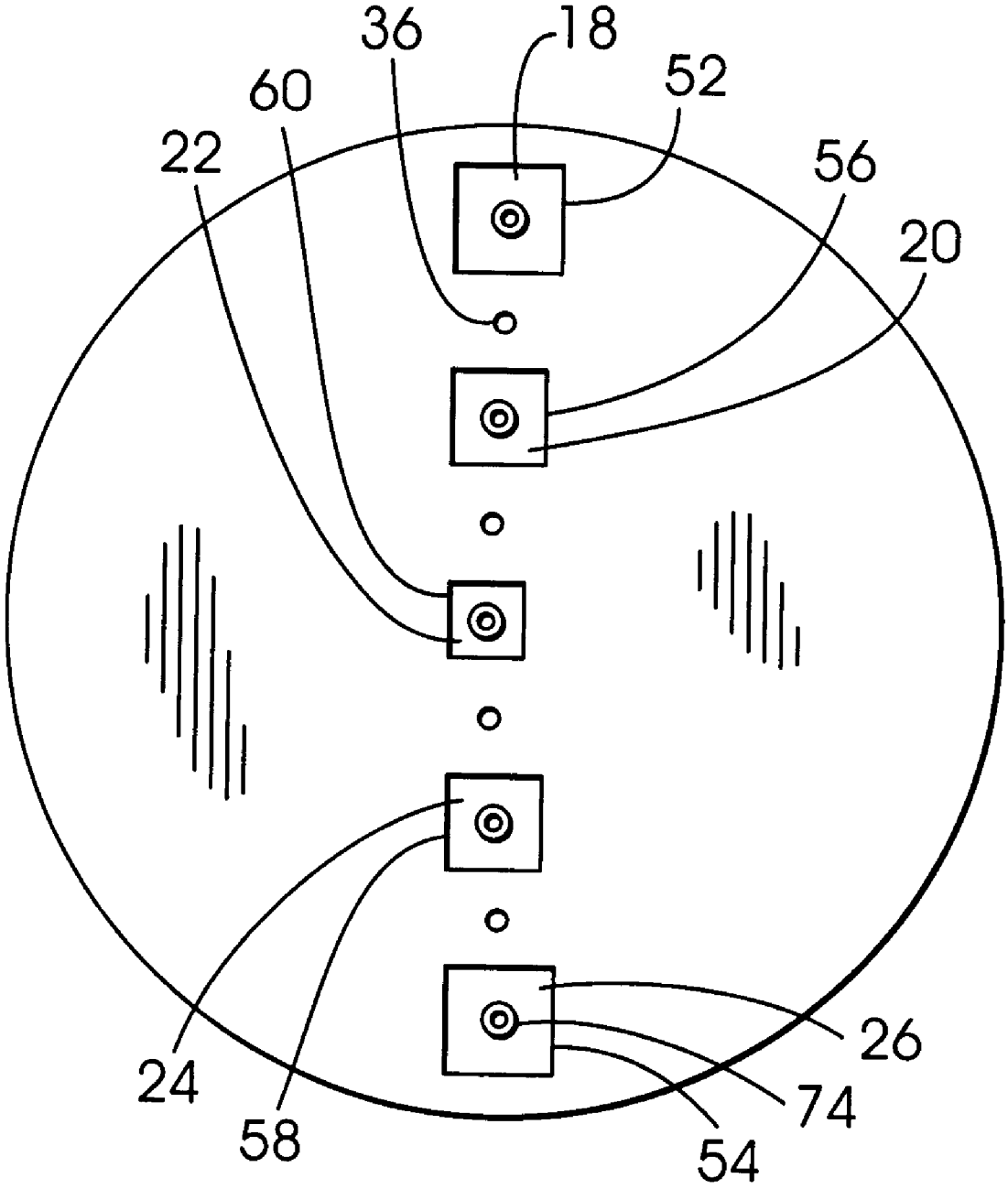
FIG. 2 is a view of the nozzle assembly which is shown in FIG. 1 and which is taken in the direction of arrow 2.

As best shown in FIG. 2, in this non-limiting embodiment of the invention, apertures 18 and 26 have a substantially identical, respective, and relatively large and generally rectangular cross sectional area 52, 54; apertures 20, 24 have a substantially identical, respective, and generally rectangular cross sectional area 56, 58 which is smaller than the cross sectional areas 52, 54; and aperture 22 has a generally rectangular cross sectional area 60 which is smaller than any and all of the cross sectional areas 52, 54, 56, and 58, and which is generally symmetrical about the longitudinal axis of symmetry 62 of the nozzle assembly 10. In this manner, it should be appreciated that the aperture 22 resides within the middle portion of the outlet aperture 16.

Figure 6:
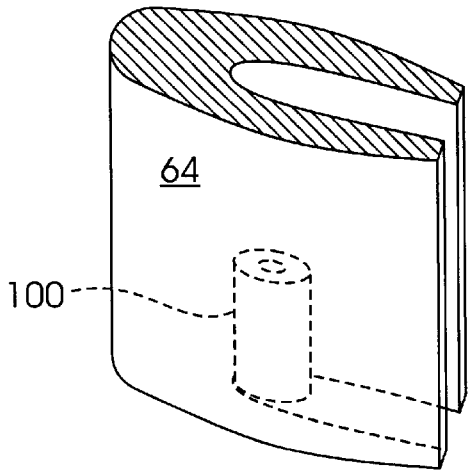
FIG. 6 is a perspective view of an injection element which is contained within the nozzle assembly which is shown in FIG. 1.

Nozzle assembly 10 further includes substantially identical and generally ellipsoidal elements 64, 66, 68, 70, and 72 which are respectively disposed within the channels 40–50 and within the apertures 18–26. Each of the elements 64–72 includes a generally "C"-shaped notch 74 which communicates with the outlet aperture 16. Elements 64–72 are each communicatively coupled to a source or receptacle 73 of liquid and/or solid particulate, such as by use of a tube which is receiveably contained within each element 64–72 and which is physically and communicatively coupled to source 73, such as tube 100 which is shown in FIG. 6. In one non-limiting embodiment of the invention, each element 64–72 is substantially identical in shape to the elements 28–34. Further, nozzle assembly 10, in one non-limiting embodiment, includes generally rectangular "blocking" elements 76–84 which are respectively deployed within channels 40–50 in relatively close proximity to the inlet aperture 12. In one non-limiting embodiment, elements 76 and 84 are substantially identical, as are elements 78 and 82. Further, in one non-limiting embodiment, substantially identical elements 76 and 84 are larger than substantially identical elements 78 and 82, and element 80, which is disposed upon the axis 62, is substantially smaller than any of the elements 76, 78, 82, and 84. In another non-limiting embodiment of the invention, each of the elements 76–84 are substantially similar and/or identical. In any of these non-limiting embodiments, it should be realized that element 80 is slightly thinner than the width of the channel 44, thereby residing within most of the space formed between the end portions of members 30, 32 which are proximate to the inlet aperture 12, and allowing received material 14 to enter channel 44 through relatively narrow openings 86, 88. Concomitantly, elements 78 and 82 respectively form substantially identical entry openings 90, 92 and 94, 96 within respective channels 42 and 46. Openings 90, 92 are substantially larger than are openings 86, 88. Further, elements 76, 84 respectively form substantially identical entry openings 98, 100, and 102, 104 within respective channels 40 and 50. Openings 98 and 100 are substantially larger than openings 94, 96 and 86, 88. Each element 76–84, 28–34, and 64–72 may be selectively formed by a silicon micromachining process.

Figure 5:
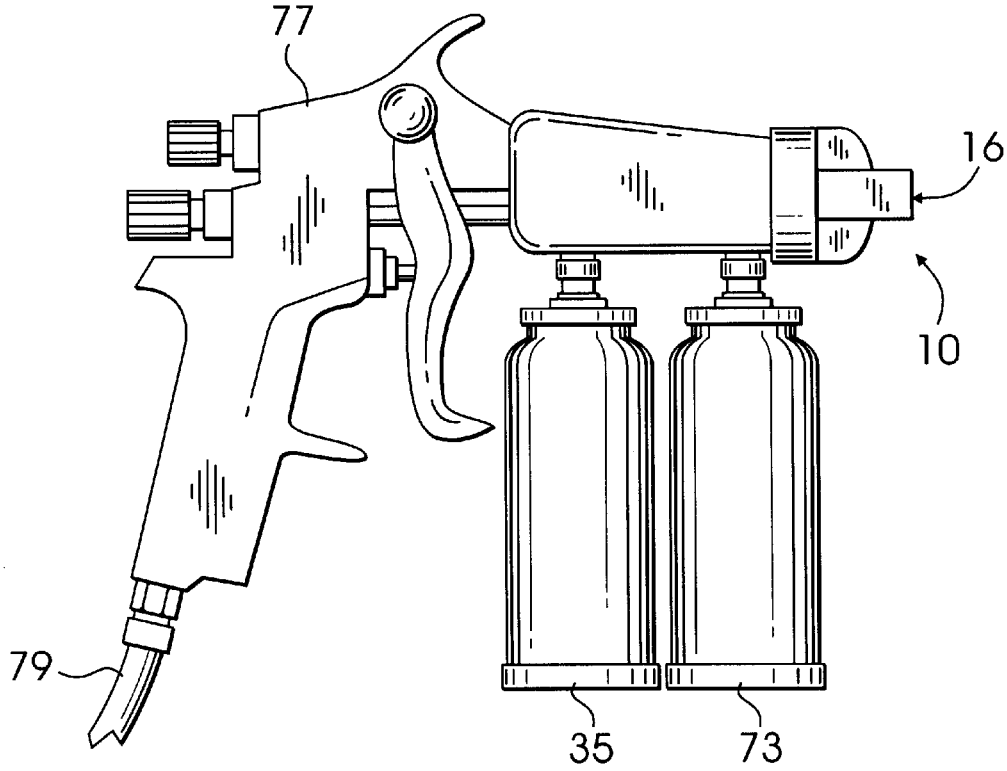
FIG. 5 is a side view of the nozzle assembly shown in FIG. 1 and which is operatively attached to a sprayer.

As best shown in FIG. 5, nozzle assembly 10 may be attached to a conventional sprayer or spray gun 77. Gas enters spray gun 77 through hose 79. Solid and/or liquid material is communicated to notches 36 from receptacle 35 and solid and/or liquid material is communicated to notches 74 from receptacle 73.

In operation, gas is injected into the inlet aperture 12. The injected gas, comprising material 14, enters the channels 40–50 through the respective opening pairs 98, 100; 90, 92; 86, 88; 94, 96; and 102, 104. The gas traverses these channels 40–50 and is mixed with liquid and/or solid particles at the outlet aperture 16. More particularly, the liquid and solid particulate material is placed within the outlet aperture 16 by the elements 28–34 and/or by the elements 64–72 and, more particularly, selectively emanate from the notched portion 36 of elements 28–34 and/or from the notched portion 74 of the elements 64–72. The mixture of the gaseous, liquid, and solid particulate material is then emitted from the nozzle assembly 10.

Importantly, the relatively narrow middle channel openings 86, 88 cooperate with the relatively narrow middle channel 44 to reduce the velocity of the material 14 which traverses the channel 44. Further, the relatively wide channel openings 98, 100 and 102, 104 cooperate with the relatively wide end channels 40, 50 to allow material 14, which traverses the channels 40, 50, to be relatively un-hindered and to have a velocity which is substantially similar to the velocity of the material 14 which traverses channel 44. Further, the openings 90, 92 and 94, 96 cooperate with the relatively narrow channels 42, 46, which are adjacent to the central or middle channel 44, to cause the velocity of the material 14 which traverses these channels 42, 46 to be substantially similar to the velocity of the material 14 which traverses channels 40, 50, and 44, thereby allowing the material 14 and/or material mixture to be emitted at a substantially similar and/or uniform velocity at each point or location within the outlet aperture 16. The previously delineated arrangement also substantially ensures that the amount of emitted material 14 and/or the amount of the emitted material mixture, emanating from the aperture 16, is substantially similar at each point or location within the aperture 16, thereby allowing for the application and/or emanation of substantially uniform concentrations of the emitted material 14.

Figure 3:
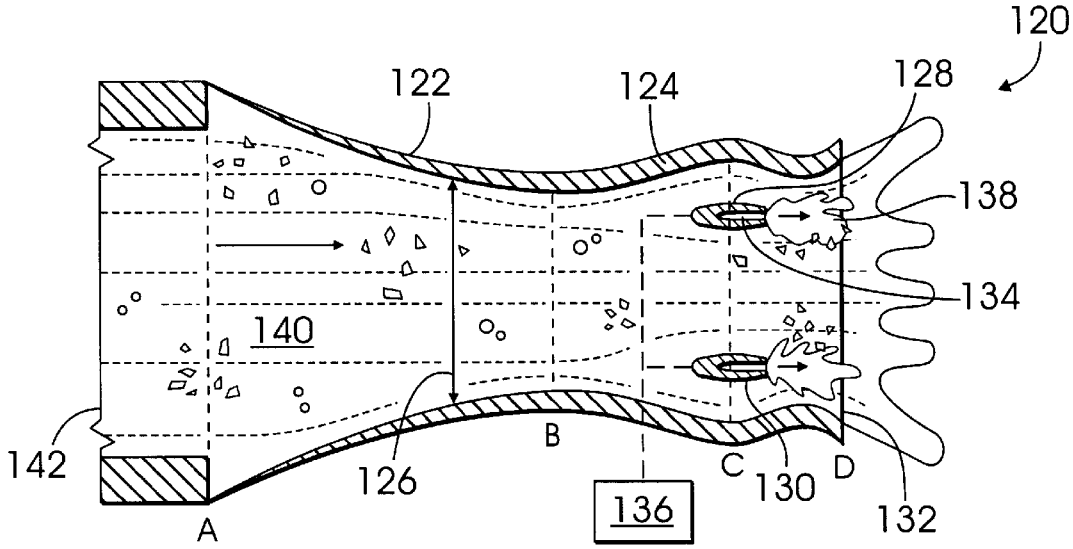
FIG. 3 is a side sectional view of a nozzle assembly which is made in accordance with the teachings of a second embodiment of the invention.

A second embodiment of the present invention is illustrated in FIG. 3. Nozzle assembly 120 is generally cylindrical and includes a tapered or "narrowed" portion or section 122 in which the diameter 126 of the nozzle assembly 10 decreases along a path or direction beginning at location "A" and ending at location "B", and a relatively rapidly "expanding" portion or section 124 which is immediately adjacent to section 122. Within section 124, the diameter 126 of the nozzle assembly 10 substantially and relatively rapidly increases from location "B" to a location "C". Two substantially identical and generally ellipsoidal elements 128, 130 are disposed in relative remote proximity to outlet aperture 132 of nozzle assembly 120. Elements 128, 130 each include a generally "C"-shaped notch 134 which is communicatively coupled to a particulate reservoir or receptacle 136, and which emits certain amounts of liquid and/or solid particulate 138 which is desired to be mixed with gaseous material 140.

Figure 4:
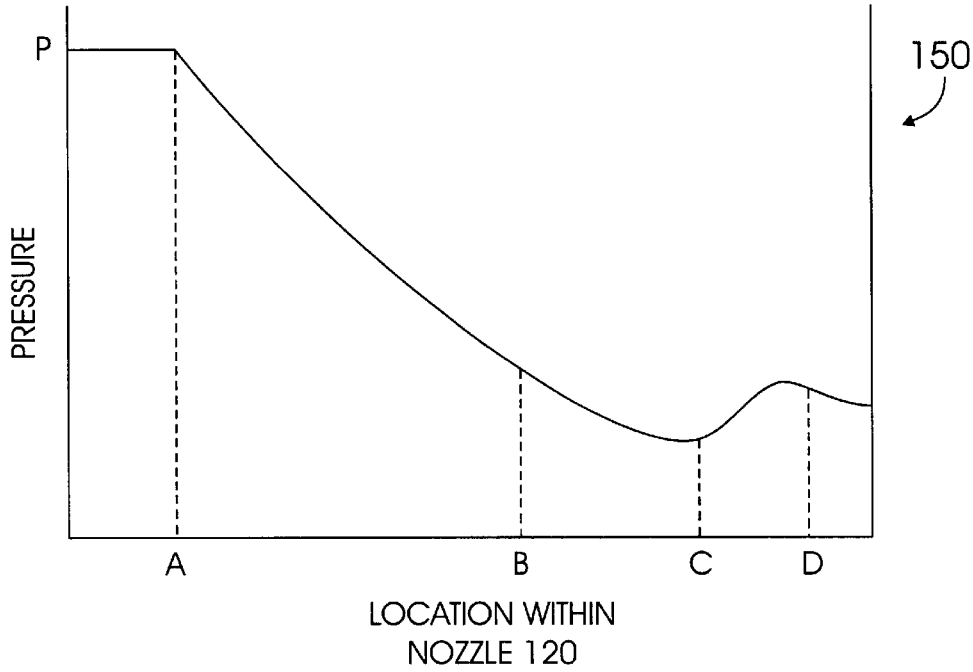
FIG. 4 is a graph of the pressure distribution within the nozzle assembly which is shown in FIG. 3.

In operation, gaseous material 140 is accelerated to relatively high and/or supersonic speeds and is communicated to nozzle assembly 120 through input aperture 142. A region of relatively low pressure is created within nozzle assembly 120 by rapidly expanding section 124. The pressure characteristics within nozzle assembly 120 are illustrated by graph 150 shown in FIG. 4. As shown, the pressure, within nozzle 120, reaches a minimum value in relative close proximity to location "C", which corresponds to the location at which notches 134 emit the liquid and/or solid particulate material 138. This arrangement allows nozzle assembly 120 to automatically entrain particulate material 138, thereby substantially obviating the need for a liquid flow-control valve and/or reducing the demands on such a valve. This novel arrangement further allows solid particulate to be introduced along with the gaseous material 140 within the outlet aperture 132, thereby reducing the susceptibility of nozzle 120 to clogging.

It is understood that the invention is not limited by the exact construction or method illustrated and described above but that the various changes and/or modifications may be made without departing from the spirit and/or the scope of Applicants' inventions.

What is claimed is:

1. A nozzle having an outlet aperture which includes a first portion having a first cross-sectional area and a second portion having a second cross sectional area which is smaller than said first cross sectional area, said nozzle further including an element which cooperates with a surface of said nozzle to form a channel; a strut which is disposed within a first end of said channel; and a blocking element which is disposed within a second end of said channel.

2. The nozzle of claim 1 wherein said nozzle is of the type which selectively emits gas and solid particles and wherein said nozzle further includes a first inlet port which receives said gas and which allows said gas to be communicated to said outlet aperture and wherein said nozzle further includes a second inlet port which receives said solid particles and which allows said solid particles to be mixed with said gas, thereby allowing said mixture of said gas and said solid particles to be emitted by said nozzle through said outlet aperture.

3. The nozzle of claim 2 further comprising a first member which is disposed within said first portion and a second member which is disposed within said second portion.

4. The nozzle of claim 3 wherein said second member resides within the middle of said outlet aperture.

5. The nozzle of claim 4 wherein said first member resides within an outer end of said outlet aperture.

6. The nozzle of claim 3 wherein said second member is generally ellipsoidal in shape.

7. The nozzle, of claim 3 wherein said first member is generally ellipsoidal in shape.

8. A nozzle of the type which receives gas and which emits gas through an outlet aperture, said nozzle having at least a first and a second element wherein said first element cooperates with a surface of said nozzle to form a first channel and wherein said second element cooperates with said first element to create a second channel, said second channel being narrower than said first channel; a first and a second blocking element, wherein said first blocking element is disposed at one end of said first channel and said second blocking element is disposed at one end of said second channel; a first and a second generally ellipsoidal strut wherein said first generally ellipsoidal strut is disposed in a second end of said first and wherein said second strut is disposed in a second end of said second channel.

9. The nozzle of claim 8 wherein said second narrower channel receives said gas from said first channel which communicates said gas to said outlet aperture and wherein said first channel further includes a first member.

10. The nozzle of claim 9 wherein said first member emits a liquid particulate.

11. The nozzle of claim 9 wherein said first member is generally ellipsoidal in shape.

12. The nozzle of claim 8 wherein said first narrow portion is formed within the middle of the nozzle.

13. A method for use with a nozzle of the type having an outlet aperture and which emits a material through said outlet aperture, said method being effective to cause said material to be emitted at a substantially uniform velocity, said method comprising the steps of:

providing a housing;

forming at least a first, a second, and a third channel within a housing, wherein said first and third channels are substantially similar;

disposing said second channel between said first and said second channels, said second channel being narrower than said first and third channels;

providing at least three blocking elements;

disposing one of said blocking elements at a first end of each of said channels;

providing a material; and communicating said provided material to each of said channels, thereby causing said provided material to traverse said nozzle and to be selectively emitted from said nozzle.

14. The method of claim 13 further comprising the steps of:

causing a first portion of the outlet aperture to have a first cross sectional area;

causing a second portion of the outlet aperture to have a second cross sectional area;

providing a first member; and disposing said first member within said outlet aperture.

15. The method of claim 14 wherein said first member emits a particulate.

16. The method of claim 13 wherein said first member is generally ellipsoidal in shape.

17. The method of claim 13 wherein said outlet aperture is generally rectangular in shape.

18. The method of claim 14 wherein said second cross sectional area is smaller than said first cross-sectional area.

19. The method of claim 18 wherein said second portion resides in the middle of said outlet aperture.

* * * * *